US007040724B2

(12) United States Patent
Kelley et al.

(10) Patent No.: US 7,040,724 B2
(45) Date of Patent: May 9, 2006

(54) EXPANDABLE HOME ENTERTAINMENT CABINET

(75) Inventors: James O. Kelley, Spring Lake, MI (US); Ralph J. Byma, Zeeland, MI (US)

(73) Assignee: Sligh Furniture Co., Holland, MI (US)

( * ) Notice: Subject to any disclaimer, the term of this patent is extended or adjusted under 35 U.S.C. 154(b) by 0 days.

(21) Appl. No.: 10/806,516

(22) Filed: Mar. 22, 2004

(65) Prior Publication Data

US 2004/0222721 A1 Nov. 11, 2004

Related U.S. Application Data

(60) Provisional application No. 60/456,776, filed on Mar. 21, 2003.

(51) Int. Cl.
*A47B 45/00* (2006.01)

(52) U.S. Cl. ..... 312/205; 312/7.2

(58) Field of Classification Search ..... 312/205, 312/204, 203, 7.2, 107, 257.1, 198; 220/8
See application file for complete search history.

(56) References Cited

U.S. PATENT DOCUMENTS 3,353,885 A * 11/1967 Hanson ..... 312/205
5,303,057 A * 4/1994 Davidow et al. ..... 348/836
5,795,041 A * 8/1998 Weaver ..... 312/205
6,283,563 B1 * 9/2001 Lambright et al. ..... 312/205
6,402,272 B1 * 6/2002 Kuvshinikov ..... 312/205

FOREIGN PATENT DOCUMENTS

DE 2620438 * 2/1978 ..... 312/205
FR 644825 * 3/1964 ..... 312/205

* cited by examiner

*Primary Examiner*—James O. Hansen
(74) *Attorney, Agent, or Firm*—Varnum Riddering

(57) ABSTRACT

An adjustable home entertainment cabinet for enclosing television sets of different sizes comprises a pair of movable tower cabinets and a bridge assembly that extends between the cabinets. A center section of the bridge rests on the tops of the cabinets. A bookshelf or shelf box is mounted on an underside of the center section. End sections movably mounted on the center section extend downwardly to cover gaps between the bookshelf and the inner sides of the tower cabinets. The center section includes a cornice molding that matches and is aligned with cornice molding on the tops of the tower cabinets. The end sections have a matching cornice molding that overlays and conceals the gap between the cornice moldings on the end sections and tower cabinets. Free standing television sets can rest on the floor. Table model sets and monitors can rest on free standing TV stands/storage cabinets of different widths that fit snugly between the tower cabinets. An adjustable media storage drawer has movable dividers with hook and loop fabric on lower edges that attach where desired to a loop fabric that covers the bottom of the drawer.

12 Claims, 16 Drawing Sheets

EXPANDABLE HOME ENTERTAINMENT CABINET

CROSS-REFERENCES TO RELATED APPLICATIONS

This is a non-provisional application based on and claiming the filing priority of now abandoned provisional patent application Ser. No. 60/456,776, filed Mar. 21, 2003.

BACKGROUND OF THE INVENTION

Cabinets known as home entertainment centers typically are used to house television sets, stereo equipment, and the like. Entertainment centers usually have a shelf or open space or receptacle of a fixed size for a television set.

A problem with fixed size entertainment centers is that they do not accommodate televisions having a variety of sizes. At the present time, with the variety of new television technologies on the market, there are a wide variety of television sizes. In order to accommodate the newest and largest size of television set, it would be necessary to make a fixed size cabinet very large. This would make the cabinet undesirable for a person with a smaller television set.

To overcome this problem, expandable cabinets have been developed wherein the height and width of a receptacle for a television set can be adjusted to fit a variety of sizes of television sets.

An object of the present invention is to provide an improved expandable home entertainment center that is easily expandable yet is solid and secure and presents a desirable visual impression of a fixed size furniture cabinet.

Other objects of the present invention are to provide improved multi-media storage and other features that are desirable in a home entertainment center.

SUMMARY OF THE INVENTION

In accordance with the present invention, an adjustable home entertainment cabinet assembly for enclosing television sets of different sizes comprises a pair of spaced tower cabinets having tops and spaced, opposed inner sides. The cabinets are movable between minimum and maximum spacing so as to position the inner sides adjacent the outer sides of television sets of different sizes. A bridge assembly extends between the tops of the cabinets and includes a center section extending between the cabinets and end sections mounted on the center section. The center section comprises an upper support member having opposite ends that rest on the tops of the cabinets and are supported thereby. The length of the support member is such that the ends of the support member are supported on the tops of the cabinets when the cabinets are spaced apart by a desired spacing between minimum and maximum limits. The center section preferably comprises a bookshelf mounted on an underside of the upper support member and extending downwardly therefrom between the cabinets. The bookshelf includes laterally spaced end panels and at least one bottom panel extending between the end panels. A pair of end sections are movably mounted on the center section and extend downwardly from the upper support member so as to cover gaps between the bookshelf end panels and the inner sides of the tower cabinets. The end sections are mounted for relative lateral movement on the upper support member so that the end sections can be positioned next to the inner sides of the cabinet for a full range of cabinet spacing between the minimum and maximum cabinet spacing.

In one aspect of the invention the center section comprises cornice molding thereon that matches and is aligned with cornice molding on the tops of the tower cabinets; and the end sections each comprise a decorative front panel having cornice molding at an upper edge that matches and overlays the cornice molding on the front panel and tower cabinets.

The end sections desirably include a generally horizontal bottom panel that extends rearward from a lower portion of the front panel and a generally vertical rear panel extending upwardly from an end of the bottom panel adjacent the tower cabinet. The end section bottom panel fits under the center section bottom panel as the end section is moved inwardly over the center section bookshelf.

The upper support member of the bridge assembly includes one or more elongated reinforcement ribs mounted on an upper support panel to restrict vertical deflection or sagging of the support panel. The upper support member includes recesses in one or more edges that engage protruding cleats on the tower cabinets to prevent the upper support member from sliding off the tower cabinet.

The cabinet preferably includes lights mounted on the tops of the tower cabinets and upper support member and are positioned to direct illumination downwardly therefrom. The upper support member can include recessed portions that permit the upper support member to slide outwardly over the lights on the tops of the tower cabinets. The lights can be actuated together by means of an electronic touch switch incorporated in a hinge of a door on a tower cabinet, such that the lights can be turned on and off by touching the hinge.

In order to provide a close fit between the cornice moldings, a gap reduction adjustment device mounted on the center section urges the cornice molding on the end sections into a close fitting relationship with the cornice molding on the tower cabinets. A back side of the cornice molding on the end sections is formed with the contour of a front side of the cornice molding on the tower cabinets so they fit together closely with minimum gaps.

The present invention can be used for free standing or floor model television sets, or it can be used for table model television sets or monitors. When table model sets are used a combination television stand and storage cabinet can be used by placing the TV stand/storage cabinet between the towers and adjusting the towers inwardly to closely abut the cabinet. By employing the same furniture appearance and flat abutting sides on the storage cabinet and the tower cabinets, the storage cabinet can appear to be integral with the tower cabinet assembly. And yet the television stand/storage cabinet can be removed from the home entertainment cabinet and used separately. Preferably at least two compatible TV stands of different widths are made available for the customer. Desirably at least two choices are provided, with widths of about 62 inches and 45 inches being desirable with present day television sizes.

In another aspect of the present invention, a media storage drawer for storing home entertainment media comprises a bottom, an upper surface of which is covered at least partially and preferably entirely with one of a hook and loop fabric, preferably a felt-type loop material. The media drawer further comprises a plurality of movable dividers for subdividing the space in the drawer. The divider has bottom engaging edges covered at least partially with the other of a hook and loop fabric. The dividers are releasably attachable to the bottom at desired locations by engagement of the hook and loop fabrics, the location of the dividers being adjustable as needed for storing different types and sizes of media. The dividers are constructed with wide enough dividers that the dividers stand on their edges when attached to the bottom of the drawer. When the media (which may be audio tapes, video tapes, CD's, or DVD's) is to be stored on their edges in rows between the dividers, backer rails having hook and loop fabric on a lower side thereof are releasably mounted on the bottom of the drawer at the ends of the rows of media in order to support the media in an upright position on their edges.

DETAILED DESCRIPTION OF PREFERRED EMBODIMENT

Figure 1:
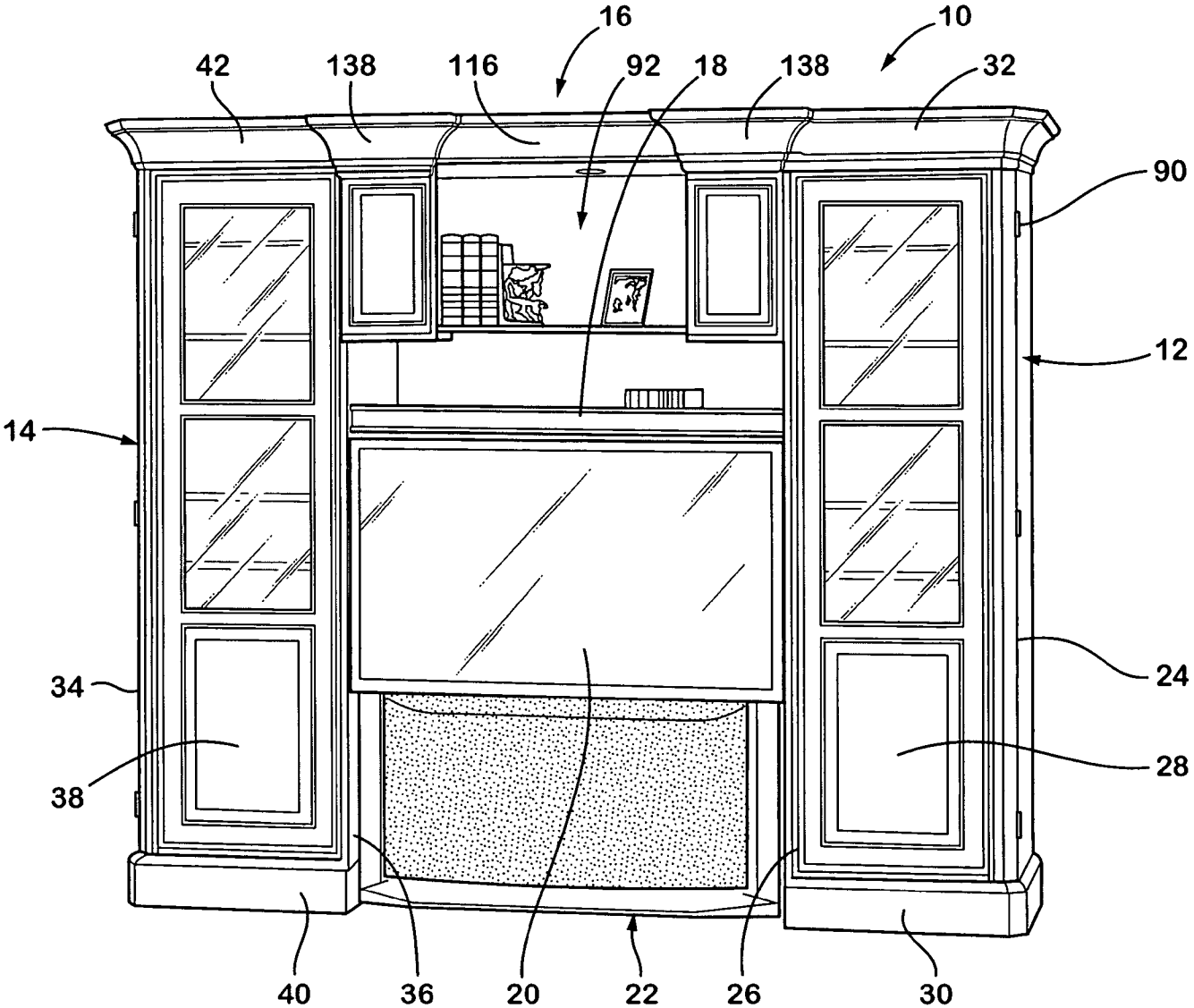
FIG. 1 is a front perspective view of a home entertainment center constructed in accordance with the present invention, shown with a television set mounted in a television receptacle therein.
Figure 2:
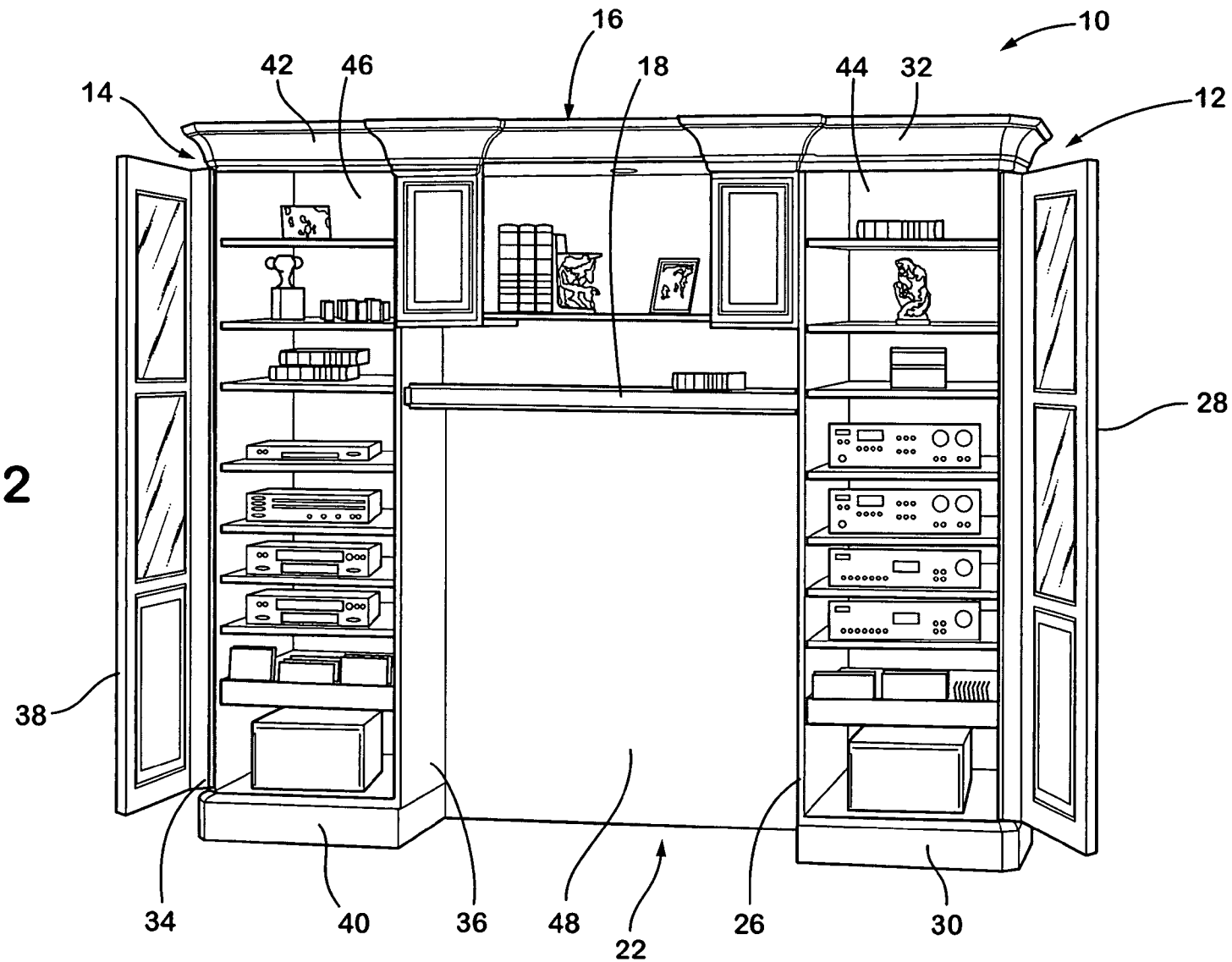
FIG. 2 is a perspective view of the entertainment center of FIG. 1, with the television set removed and with the cabinet doors open.
Figure 3:
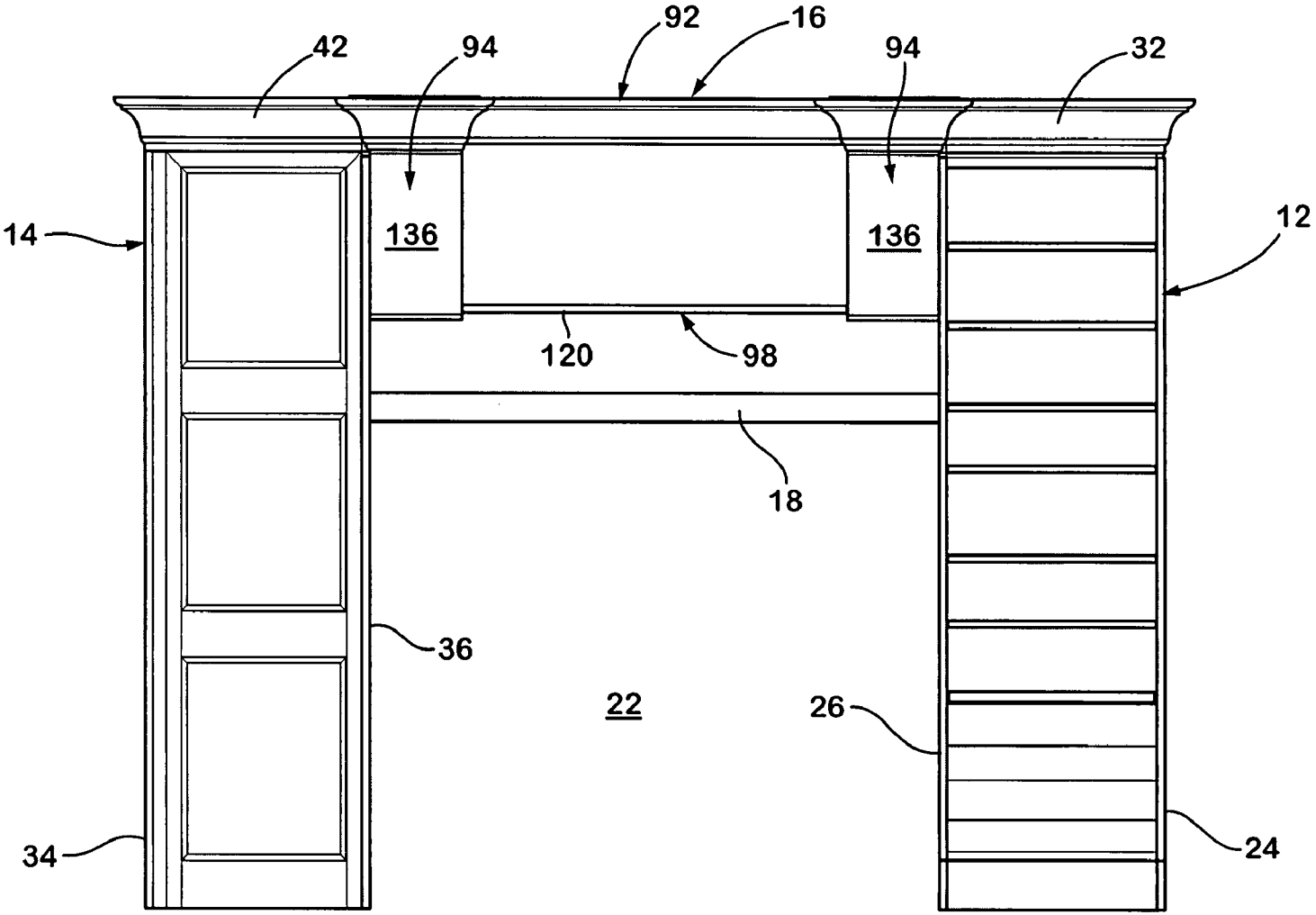
FIG. 3 is a front elevational view of the entertainment center of FIG. 1.

Referring now to the drawings, a furniture assembly 10 known as a home entertainment center or home theater is shown in FIG. 1. Entertainment center 10 comprises a pair of tower cabinets 12 and 14 spaced apart, with a bridge assembly 16 suspended between the two towers. An expandable shelf assembly 18 also can be suspended between cabinets 12 and 14. Television set 20 is positioned in a receptacle 22 formed below shelf 18 and between cabinets 12 and 14. Television set 20, as illustrated, rests on the floor. A feature of the present invention is that the size of the television receptacle can be modified to accommodate the size of a variety of different television sets or television monitors. A shelf or pedestal can be provided in order to support a television set that does not have a base. A front panel can be cut to size to cover the base of television set 20, if desired. The front panel can be provided with base molding.

Towers 12 and 14 are free-standing cabinets. Right tower 12 comprises an outer side panel 24, an inner side panel 26, hinged front door 28, base molding 30, and upper cornice molding 32. Left tower 14 includes an outer panel 34 an inner panel 36, hinged door 38, a base molding 40, and an upper cornice molding 42. Cornice moldings 32 and 42 desirably are the same and are aligned. The towers have backs 44 and 46, and a back 48 is positioned at the rear of the television receptacle 22. Back 48 desirably is formed of a black tricot fabric that hangs downwardly behind the television receptacle from the body assembly 16. A rod at the lower edge of the fabric holds the fabric down. The cloth provides ventilation and can deform around a television set.

Figure 5:
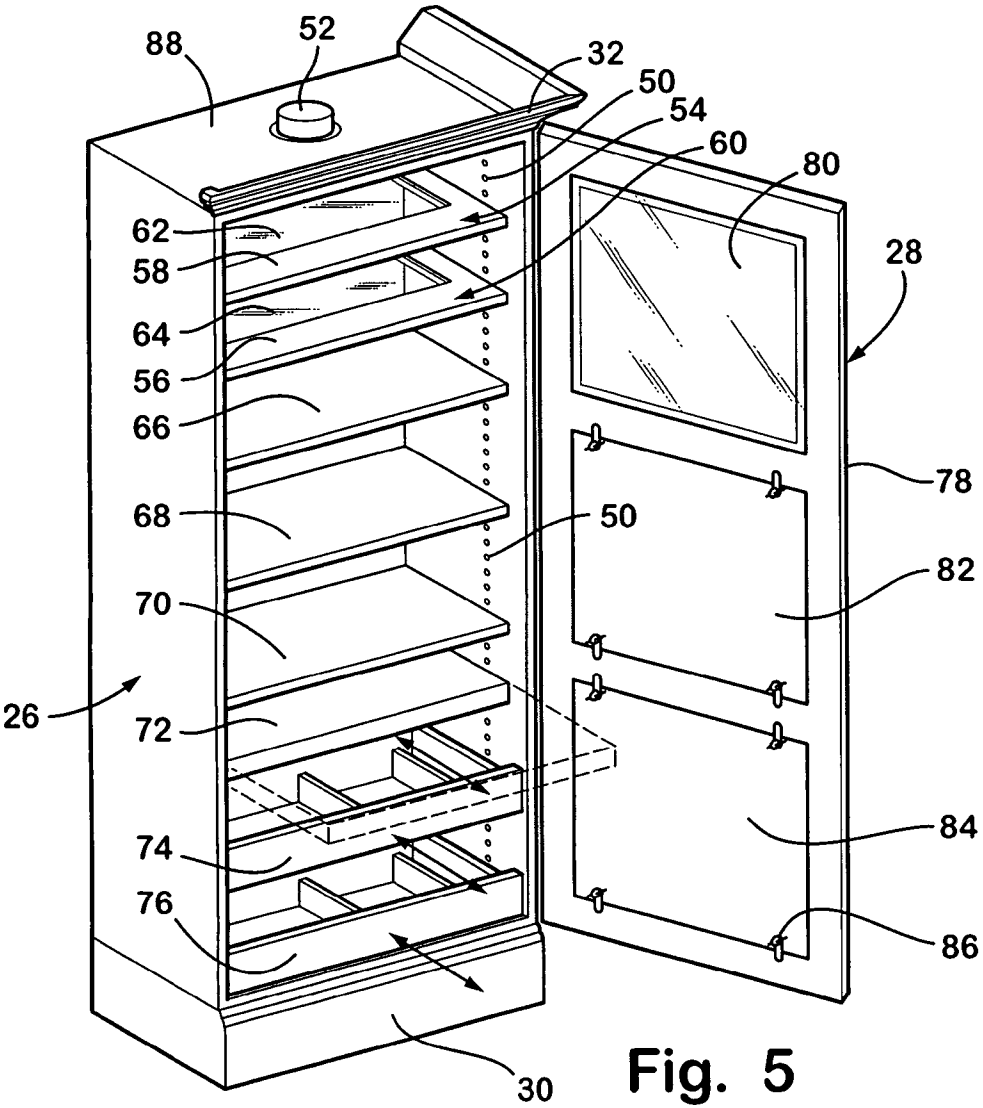
FIG. 5 is a perspective view of one of the tower cabinets of the present invention, the other tower cabinet being a mirror image thereof.
Figure 6:
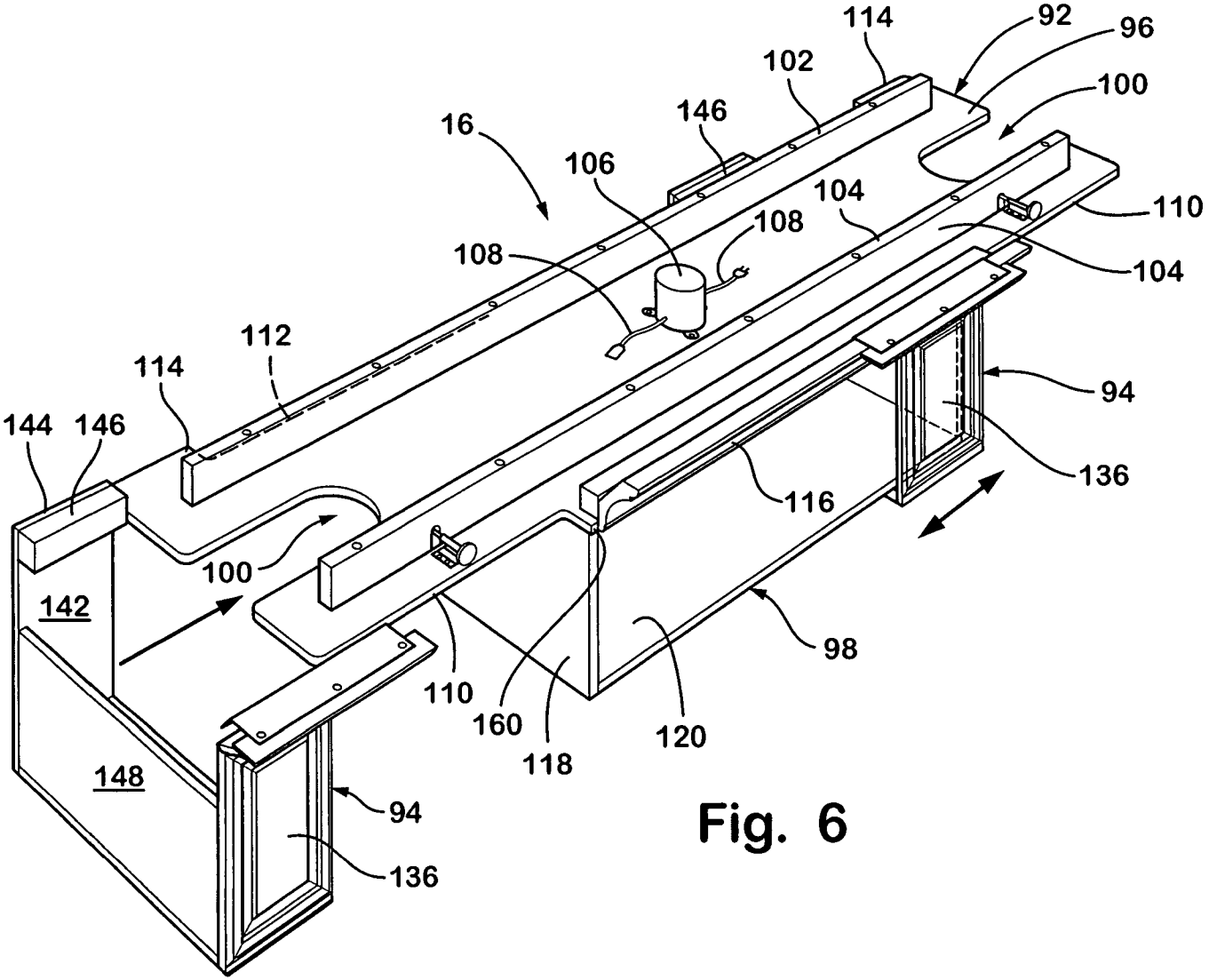
FIG. 6 is a perspective view of a bridge assembly of the present invention.
Figure 7:
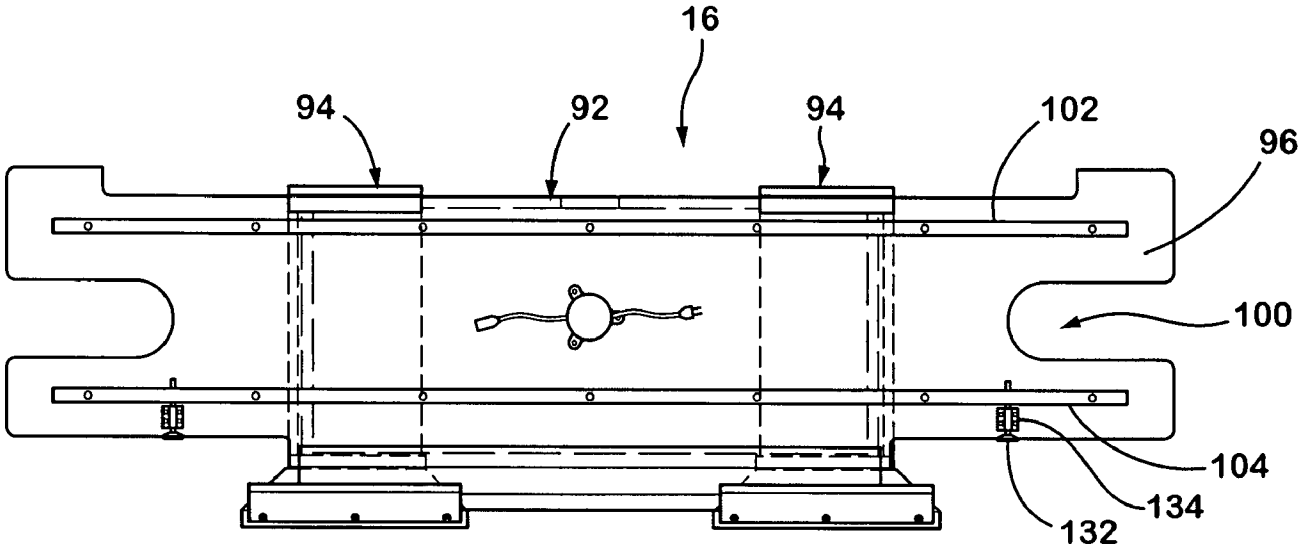
FIG. 7 is a plan view of the bridge assembly of FIG. 6.
Figure 8:
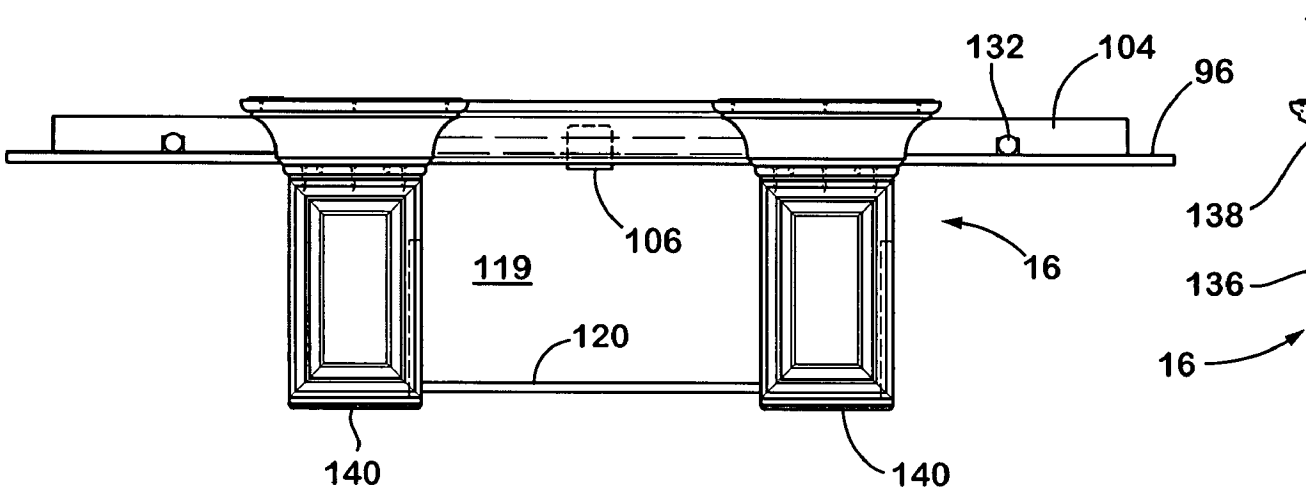
FIG. 8 is a front elevational view of the bridge assembly of FIG. 7.
Figure 9:
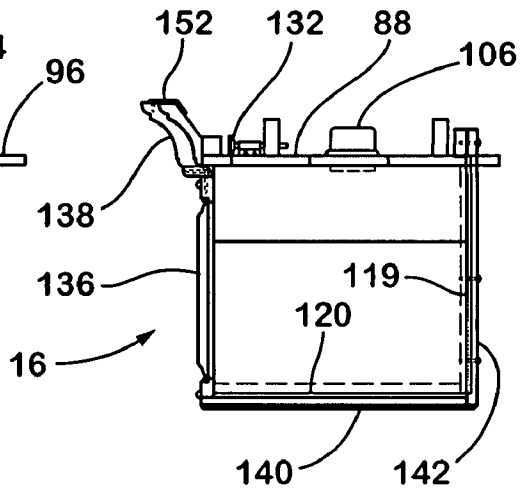
FIG. 9 is an end view of the bridge unit of FIG. 7.
Figure 10:
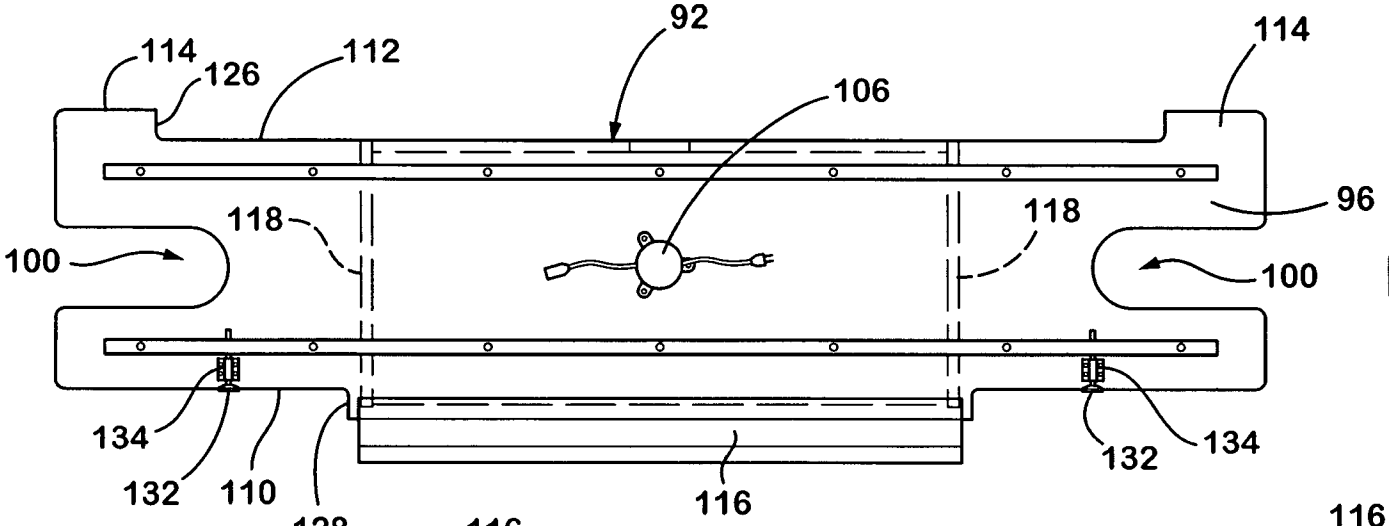
FIG. 10 is a plan view of the center section of the bridge assembly.
Figure 12:
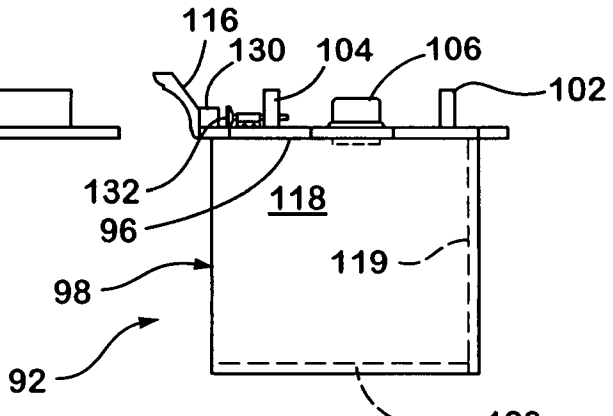
FIG. 12 is an end view of the center section of FIG. 10.

The construction of the tower cabinets or towers is shown in more detail in FIG. 5. Tower cabinet 12 has a number of shelves and drawers mounted in the open interior of the cabinet by means of conventional shelf supports and drawer glides that are adjustably mounted in spaced holes 50 along the sides of the cabinet. Desirably, the cabinets include a can light 52 at an upper end thereof which directs illumination downwardly in the interior of the cabinet. Two shelves 54 and 56 positioned at the upper end of the cabinet include frames 58 and 60 that have light transmitting plate glass inserts 62 and 64 therein. The inserts transmit light downwardly into the interior of the cabinet.

Shelves 66, 68, and 70, desirably are fixed position shelves mounted on conventional shelf support brackets that fit in openings 50.

A lower shelf 72 desirably is mounted on a conventional ball bearing drawer glide or slide mount (not shown) for more easy access to the rear of the lower shelf.

Media storage drawers 74 and 76 are also mounted on ball bearing drawer slides for opening and closing the drawers. Construction of the media drawers is disclosed in FIGS. 17–23 and described below.

Door 28 includes a frame 78 and panels 80, 82, and 84 mounted in the frame by fasteners 86. These panels are changeable and may optionally be glass, wood, or speaker cloth. In the illustrated embodiment, panels 80 and 82 are glass and panel 84 is wood.

The top of the cabinet 12 is covered by a top 88, which is surrounded on the front and outer sides by cornice molding 32. The construction of the other tower 14 is substantially the same.

Both towers can be wired for electronics and desirably include a surge suppressor with multiple plug receptacles. Desirably, the can light 52 is illuminated by a touch switch 90 incorporated into the upper hinge of door 28. This touch switch will illuminate the can light 52 when the hinge is touched. Continuing to touch the hinge will vary the intensity of the light. This avoids the necessity of a separate switch for the interior can light and facilitates illumination and adjustment of illumination of this light. There are multiple can lights in the present invention, one for each tower, and one for the bridge center section. These can all be connected together so that they are operated by one switch, if desired.

Towers 12 and 14 are free standing and are adjustable toward and away from each other to provide a variable size opening or receptacle for a television receiver. Bridge assembly 16 extends between the upper ends of towers 12 and 14 and creates the impression of a single non-adjustable piece of furniture. Adjustable shelf 18 desirably is positioned below bridge assembly 16 at a position just above the television set.

The construction of bridge assembly 16 is shown in FIGS. 4–16. Bridge assembly 16 includes a center section 92 and movable end sections 94 adjustably mounted at spaced apart locations on the center section.

Center section 92 includes an upper support panel or spanner member 96 and a bookshelf unit 98 mounted on the underside of the spanner member at the center thereof. The spanner member 96 includes U-shaped openings 100 in the ends thereof. Elongated reinforcement ribs 102 and 104 extend longitudinally on the upper surface of panel 96. A can light 106 is mounted in the center of the spanner member and can be connected by electrical cords 108 to the electrical circuitry for the can lights in the tower cabinets. Panel 96 includes recesses 110 at the ends of front edges thereof and an elongated recess 112 in a center portion of a rear edge thereof, leaving outwardly extending portions 114 on the ends of the rear sides of panel 96. A center section cornice molding 116 (shown schematically in FIG. 6 but shown in more detail in FIGS. 7, 8, and 9) is mounted on the front edge 160 of the center of the upper support panel 96.

Figure 4:
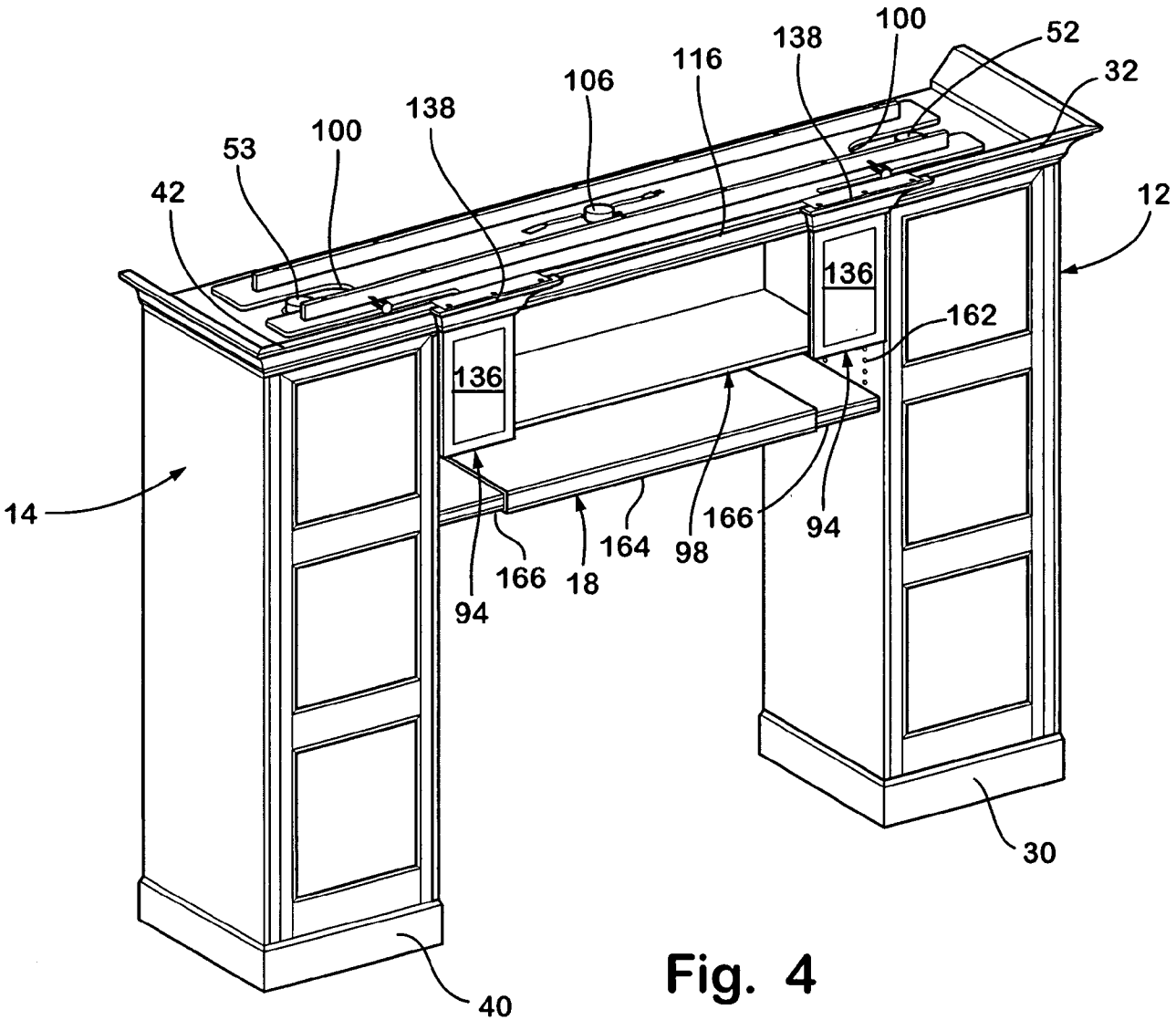
FIG. 4 is an upper front perspective view of the entertainment center of the present invention.

As shown in FIG. 4, recesses 100 make it possible for the support panel to expand over can lights 52 and 53.

Figure 11:
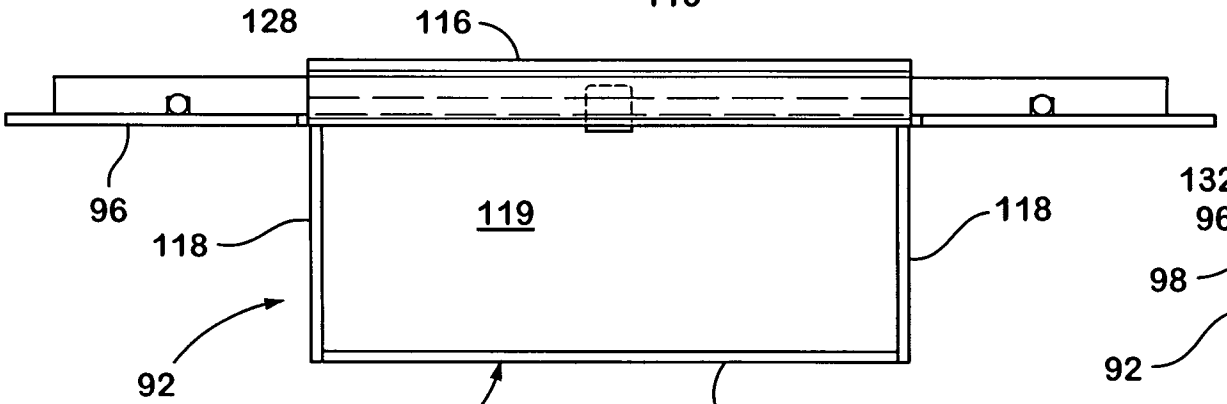
FIG. 11 is a front elevational view of the center section of FIG. 10.

Bookshelf or shelf box 98, as shown in FIG. 11, comprises end panels 118 extending downwardly from the underside of spanner member 96, bottom panel 120 extending between lower ends of end panels 118 and back panel 119. The space between end panels 118 is essentially the narrowest adjustable space between towers 12 and 14. Center section cornice molding 116 is mounted on the front edge of center section 92 and extends upwardly from spanner member 96 so as to conceal the can light and reinforcing ribs behind the molding. Cornice molding 116 desirably has a decorative configuration that is compatible with the cornice molding on the towers. It desirably is generally in alignment with the cornice molding on the towers.

Figure 13:
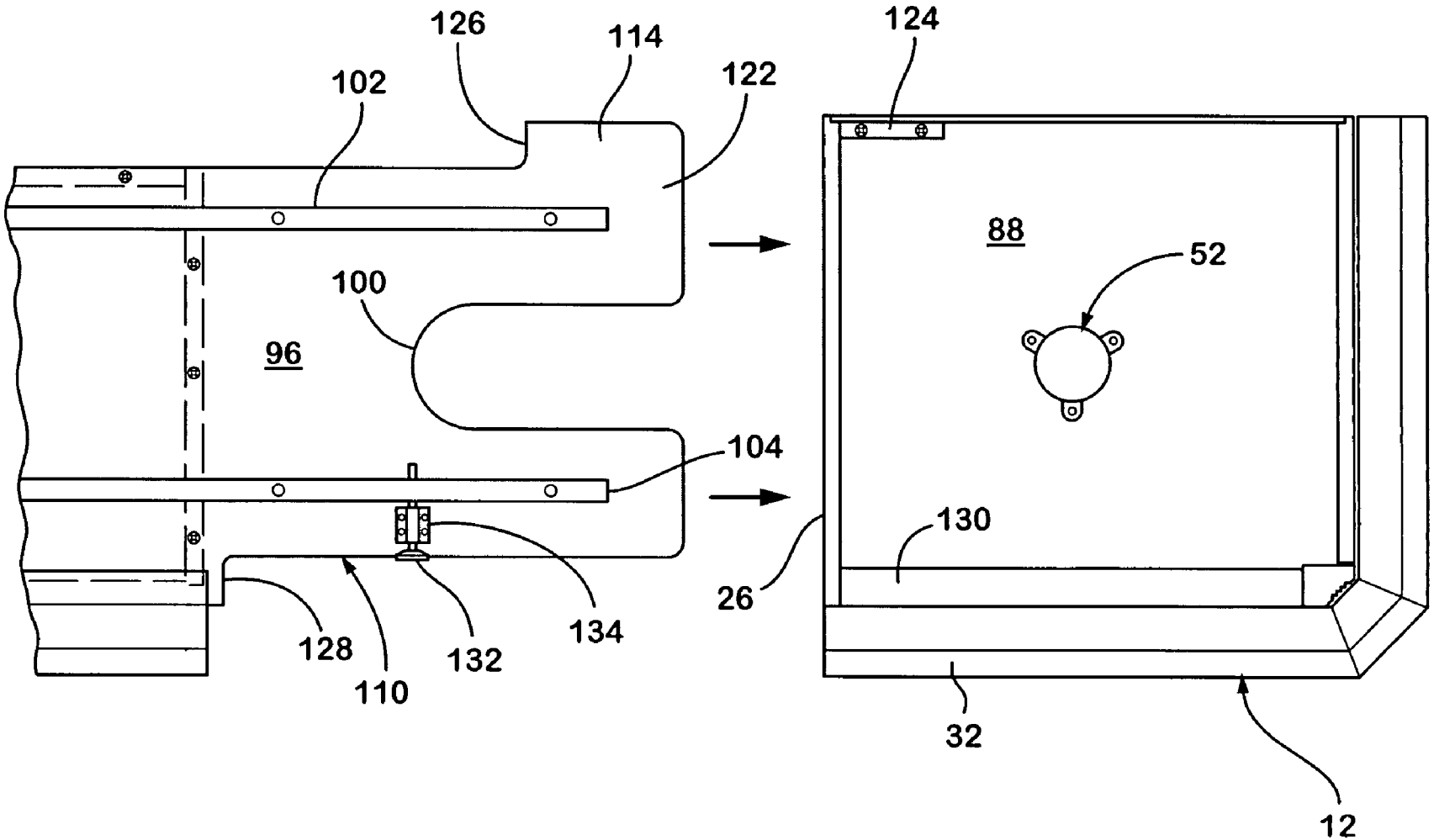
FIG. 13 is a plan view showing the manner in which the end of the center section is mounted on the top of a tower cabinet.

The manner in which center section 92 is mounted on the tops of the towers 12 and 14 is shown in FIG. 13. End 122 of spanner member 96 is moved to a position over top 88 of cabinet 12, with slot 100 fitting around can light 52. Rearwardly extending portion 114 fits behind a cleat 124 on the rear inner edge of top 88, so that edge 126 at the rear edge of outwardly extending portion 114 engages the cleat to prevent the center section from sliding outwardly too far and sliding completely off of tower cabinets 12 or 14. An inner edge 128 of recess 110 engages cleat member 130 on the front edge of the top of cabinet 12 to limit outer movement of the center section with respect to tower 12. The distance between edges 126 and 128 thus defines the maximum movement of the center section with respect to each tower.

A gap reduction adjuster screw 132 on each side of spanner member 96 is threadably mounted in a bracket 134 and can be adjusted to move forwardly and backwardly in order to push the center section rearwardly against cleat 130 on the top of the front edge of cabinets 12 and 14.

This makes it possible to adjust the center section rearwardly so that it is snugly engagement with the cornice molding on the upper ends of the tower cabinets.

The outer and inner adjustment of the towers with respect to the center section produces an increase in the space between end panels 118 of the bookshelf unit and inner panels 26 and 36 of spaced tower units 12 and 14. To conceal this space, end sections 94 are movably mounted on the center section and positioned so as to cover the space between end panels 118 and the inner panels of the spaced towers. End sections 94 are identical except that they are mirror images of each other. For purposes of convenience, only one end section will be described herein.

Figure 16:
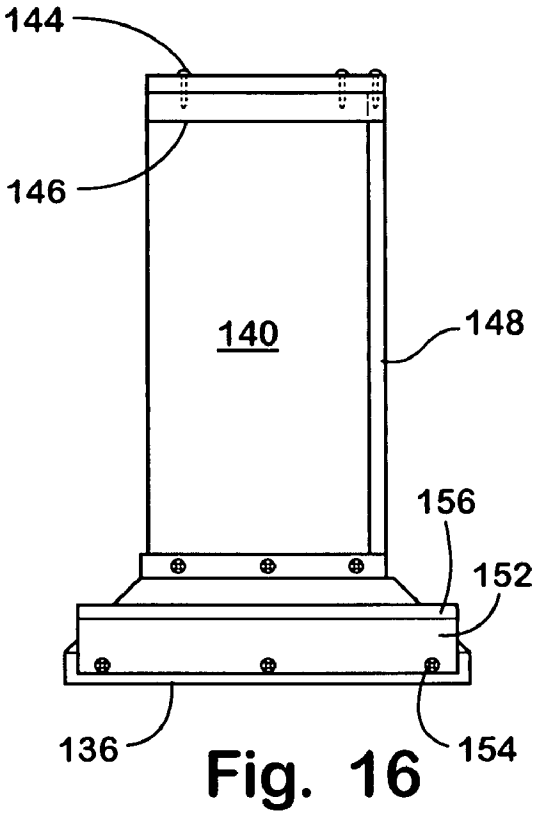
FIG. 16 is an end view of the movable end section of FIG. 14.
Figure 15:
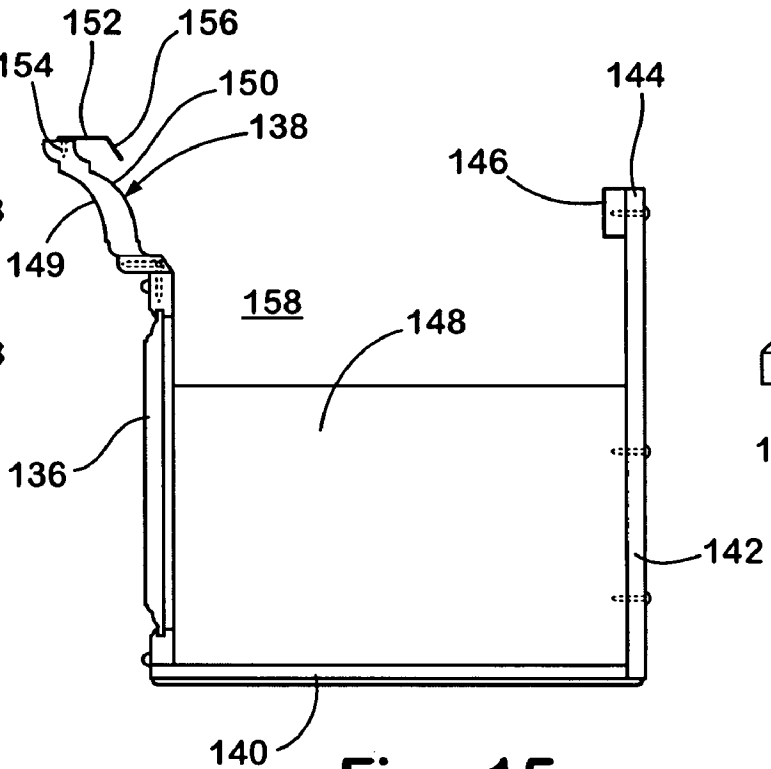
FIG. 15 is a front elevational view of the movable end section of FIG. 14.
Figure 14:
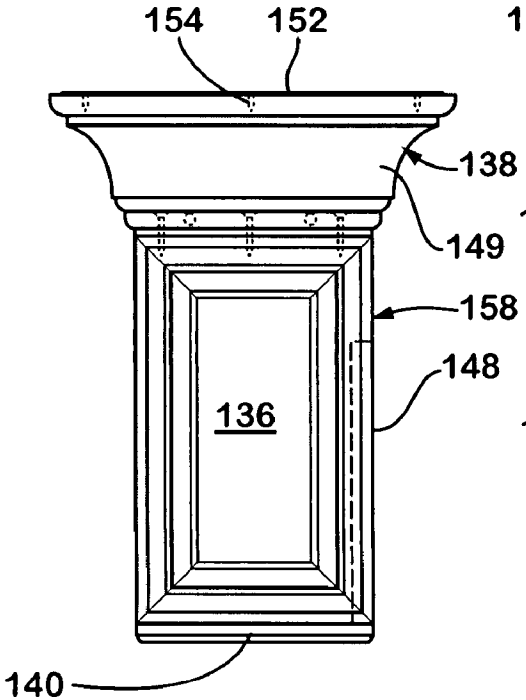
FIG. 14 is a plan view of a movable end section of the present invention.

Referring to FIGS. 14–16, the right end section 94 comprises a decorative front panel 136 attached at an upper edge to end section cornice molding 138 and attached at a lower end to a bottom panel 140. Bottom panel 140 extends rearwardly to a rear panel 142, which extends upwardly to an upper end 144 having a cleat 146 extending inwardly therefrom. The various components are attached together by threaded fasteners. An outer end panel 148 covers an outer end of the end section.

Cornice molding 138 has a decorative outer surface 149 that is compatible with or the same as the outer surface of cornice molding 32 and cornice molding 116. An inner surface 150 of cornice molding 138 is shaped in the form of cornice molding 116 so that cornice molding 116 mates with inner surface 150. A support bracket 152 is attached by threaded fasteners 154 to the upper end of cornice molding 138 and extends inwardly and then downwardly at an inner end 156.

As shown in FIGS. 6 and 7–9, end sections 94 fit on the center section 92, with cleat 146 on the upper end of rear panel 144 riding on the rear edge of spanner member 96 on the edge of recessed section 112. The front edge of each end section is mounted on center cornice molding 116, with bracket 152 resting on the top of cornice molding 116 and flange 156 fitting behind the cornice molding. The inclination in the flange urges the cornice moldings into contact with each other.

An open space 158 above the upper edge of end panel 148 makes it possible to lift the end sections upwardly and slide them over into mounted position on spanner member 96. The recess 110 makes it possible to fit end section over the end 122 of the spanner member and the rearwardly extending portion 114 thereof and then permitting the end sections to be moved forwardly so that they then are retained between recessed rear portion 112 and front edge 160 of the spanner member.

The end sections thus constructed and mounted on the center section are suspended on the center section and are movable inwardly and outwardly as desired in order to cover the space between the towers and the end panels of the bookshelf portion of the center section.

The adjustable shelf 18 is not attached to either side panel but instead rests on conventional shelf mounting brackets that can be fitted into evenly spaced mounting bracket holes 162 spaced along opposed inner sides of towers 12 and 14. Desirably, there are four or so holes spaced apart so that the shelf spacing can be adjusted by four inches or more as desired. Adjustable shelf 18 includes a center section 164 with extendable end sections 166 telescopically or slidably received therein in a conventional matter. The outer ends of the end sections can simply rest on shelf mounting brackets positioned in holes 162 in the towers. The extendable shelf may be lockable at its selected length so that it rests on the shelf brackets.

Another feature of the present invention is the construction of media drawers 74 and 76, which essentially are identical. For reference, a single media drawer 74 is described below and shown in FIGS. 17–23. Media drawer 74 comprises a rectangular frame or drawer box 186 defined by front and rear panels 168 and 170, side panels 172 and 174, and bottom 176. The bottom is covered with fabric 178 that serves as one of the components of a hook and loop fastener system, desirably, the loop portion of the fastener system. Fabric 178 can be a felt type material.

Figure 18:
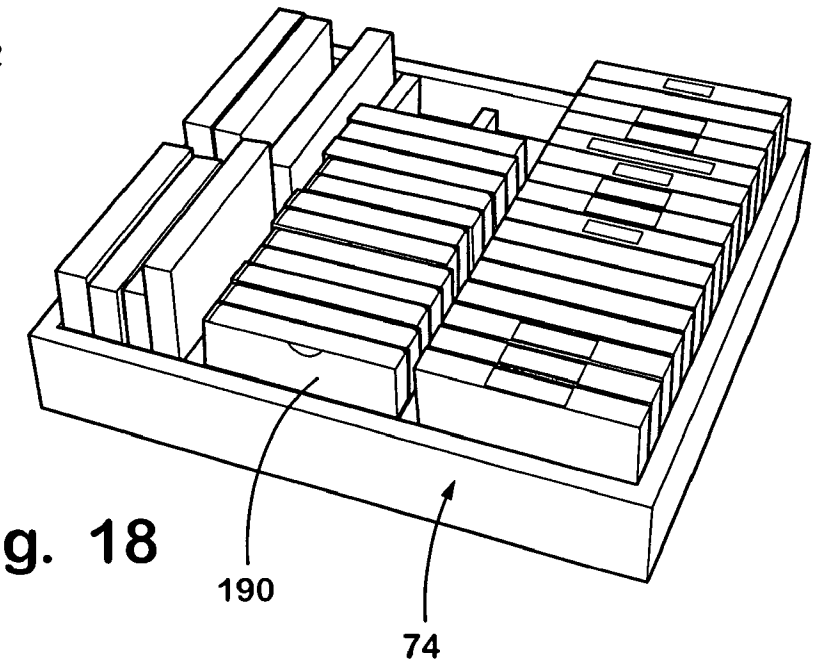
FIG. 18 is a perspective view of the media drawer of FIG. 17 showing a different arrangement of media stored in the drawer.
Figure 17:
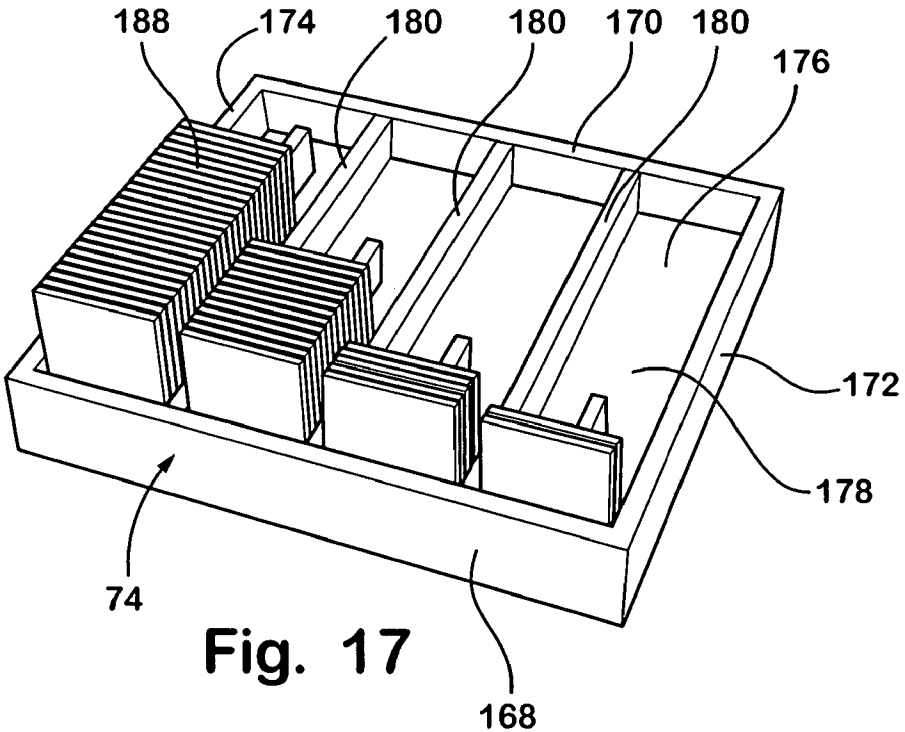
FIG. 17 is a perspective view of a media storage drawer constructed in accordance with the present invention, showing one arrangement of media in the drawer.
Figure 19:
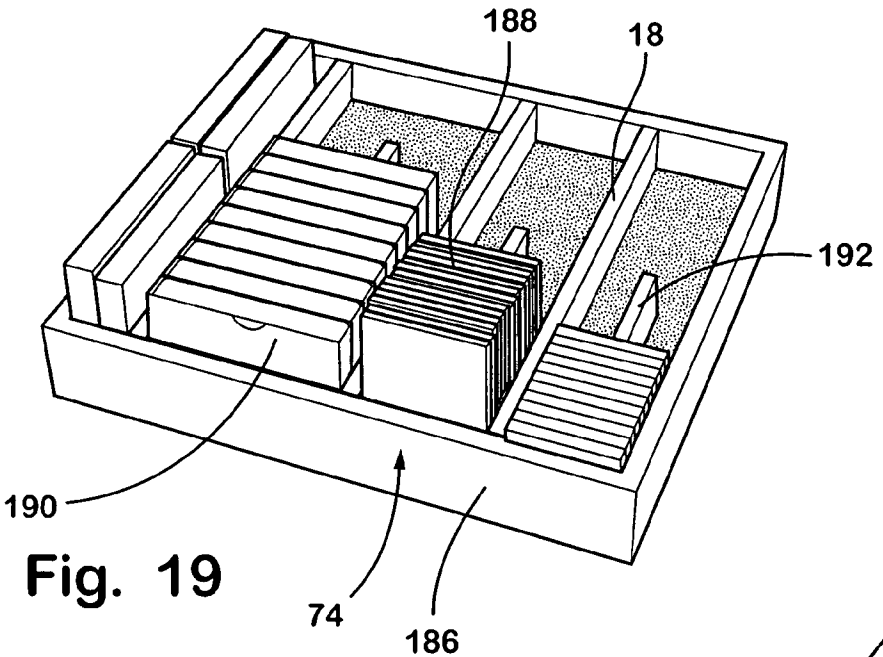
FIG. 19 is a perspective view of the media drawer of FIG. 17 showing yet a different arrangement of media stored in the drawer.
Figure 20:
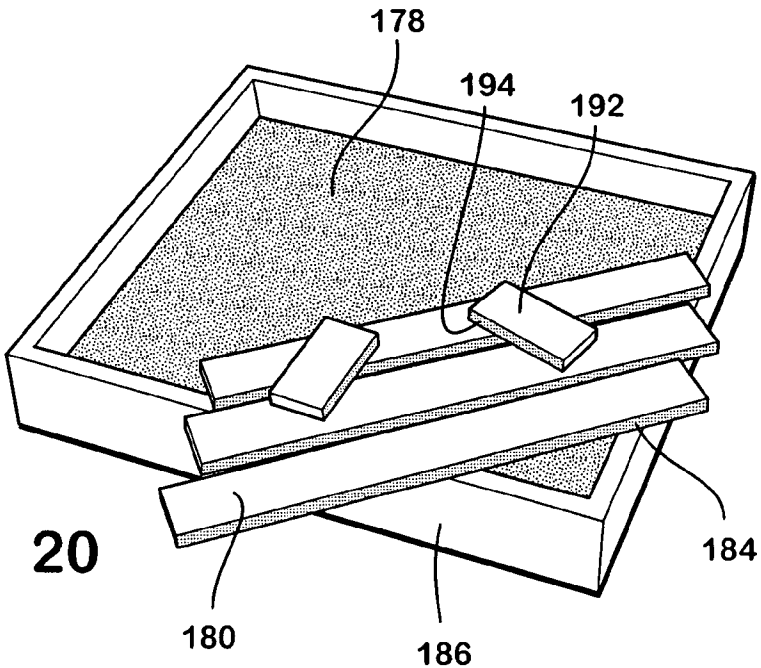
FIG. 20 is a perspective view showing the media drawer of FIG. 17, with the component parts disassembled.
Figure 21:
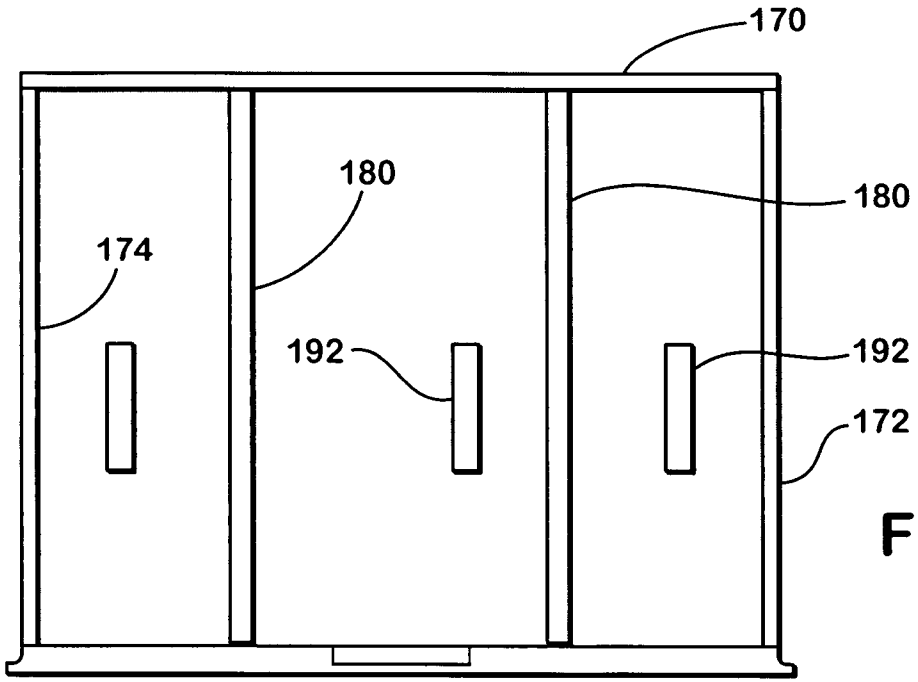
FIG. 21 is an end view of the media drawer of FIG. 17, showing one arrangement of media dividers.

The interior of the media drawer is subdivided by a plurality of removable long dividers 180, each of which is provided with a layer of hook and loop fastener material 184 on the underside thereof that is compatible with the fabric 178 on the upper surface of the bottom off the drawer. The long dividers thus can be fixed in place in any position in the drawer box 186 in order to create subdivided compartments of any desired size. Thus, various sizes of media can be placed in the drawer. For example, the drawer can be divided to accept four rows of CD's 188, as shown in FIG. 17; or the drawer can be subdivided to accept various sizes of video tapes 190, as shown in FIG. 18; or a combination of both, shown in FIG. 19.

Figure 22:
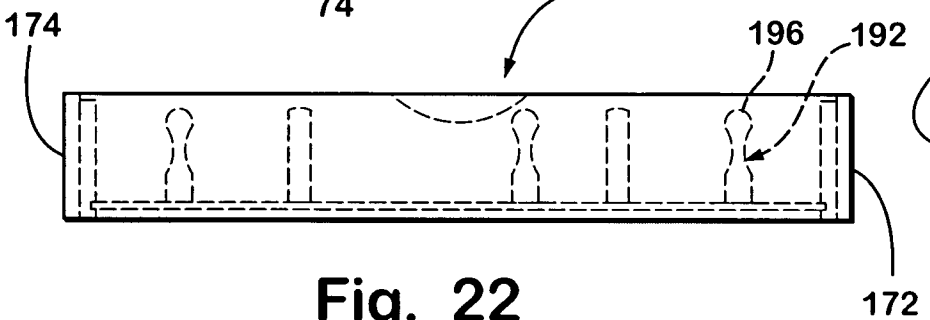
FIG. 22 is a front elevational view of the media drawer of FIG. 21.
Figure 23:
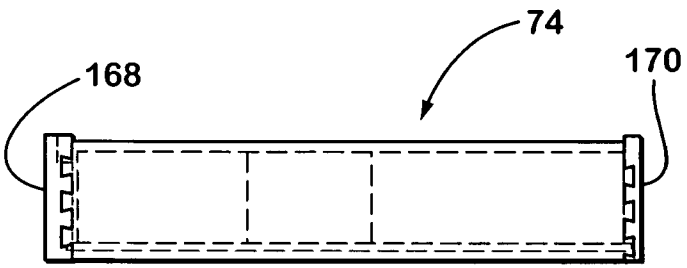
FIG. 23 is an end view of the media drawer of FIG. 21.
Figure 24:
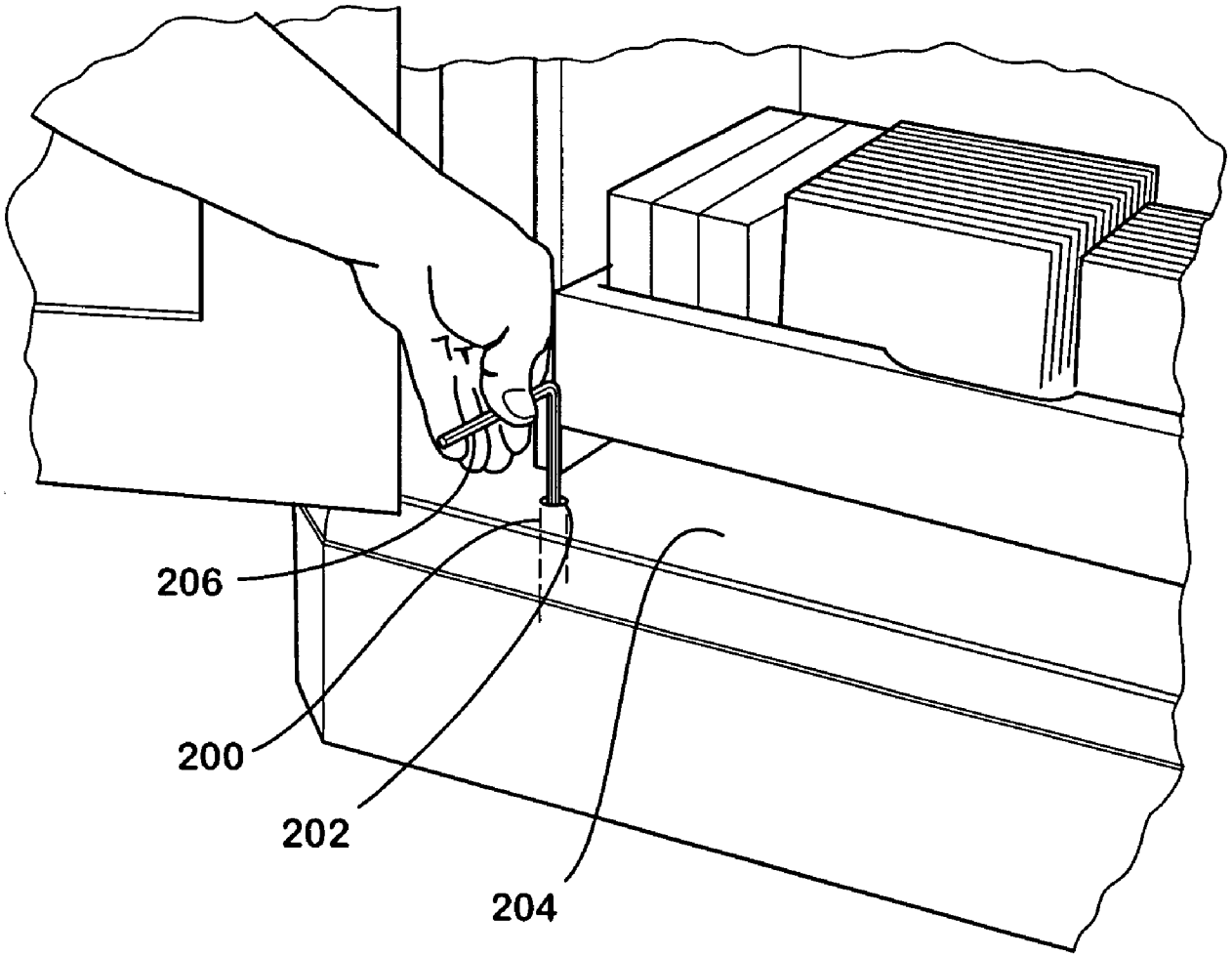
FIG. 24 is a perspective view showing the tower leveling mechanism of the present invention.

The media cases are held in an upright position by means of relatively short backer rails 192, each of which is provided with a hook and loop fastener surface 194 on an underside thereof. The hook and loop fastener surface engages and is held in place by the hook and loop fastener material on the bottom of the drawer. Backers 192 can have a rounded gripping surface 196 on an upper end thereof, as shown in FIG. 22, for ease of gripping the backers.

With the media drawers of the present invention, virtually any type and quantity of media can be stored in a neat, upright position in the media drawer, and the media drawer can be rearranged at will to accommodate any changes in media preferences.

The towers of the present invention are free-standing and yet present a unitary appearance with the bridge assembly suspended between the towers. In order to make the towers secure in their position, conventional leveling devices 200 are incorporated in the corners of the tower. These are accessible easily through openings 202 in an upper surface of base 204. A convenient tool 206 can be inserted through opening 202 and manipulated by hand in order to level the base so that it does not wobble.

In FIG. 1, the entertainment center 10 is shown as it is set up to accommodate a large floor mounted television set 20. The cabinet can also be used to house a table model television set 210 wherein either the entire set rests on a table or the monitor is separated from the television tuner and amplifier or receiver, and the monitor rests on a table or base. In such a case, shown in FIGS. 25–27, a television stand and storage cabinet 212 (FIGS. 25 and 26) can be employed. The television stand and storage cabinet 212 is styled in the same furniture appearance as the entertainment center and is formed so that it can be fitted between the tower cabinets 214 and 216. The tower cabinets have flat vertical side panels 218 and 220 that mate flush with flat panels 222 and 224 on the storage cabinet so that the storage cabinet has the appearance of being integral with the tower cabinets when the tower cabinets are moved into abutting contact with the storage cabinet. A lower molding panel 226 aligns with identical molding panels on the tower cabinets and creates the impression of one continuous piece of furniture.

Figure 25:
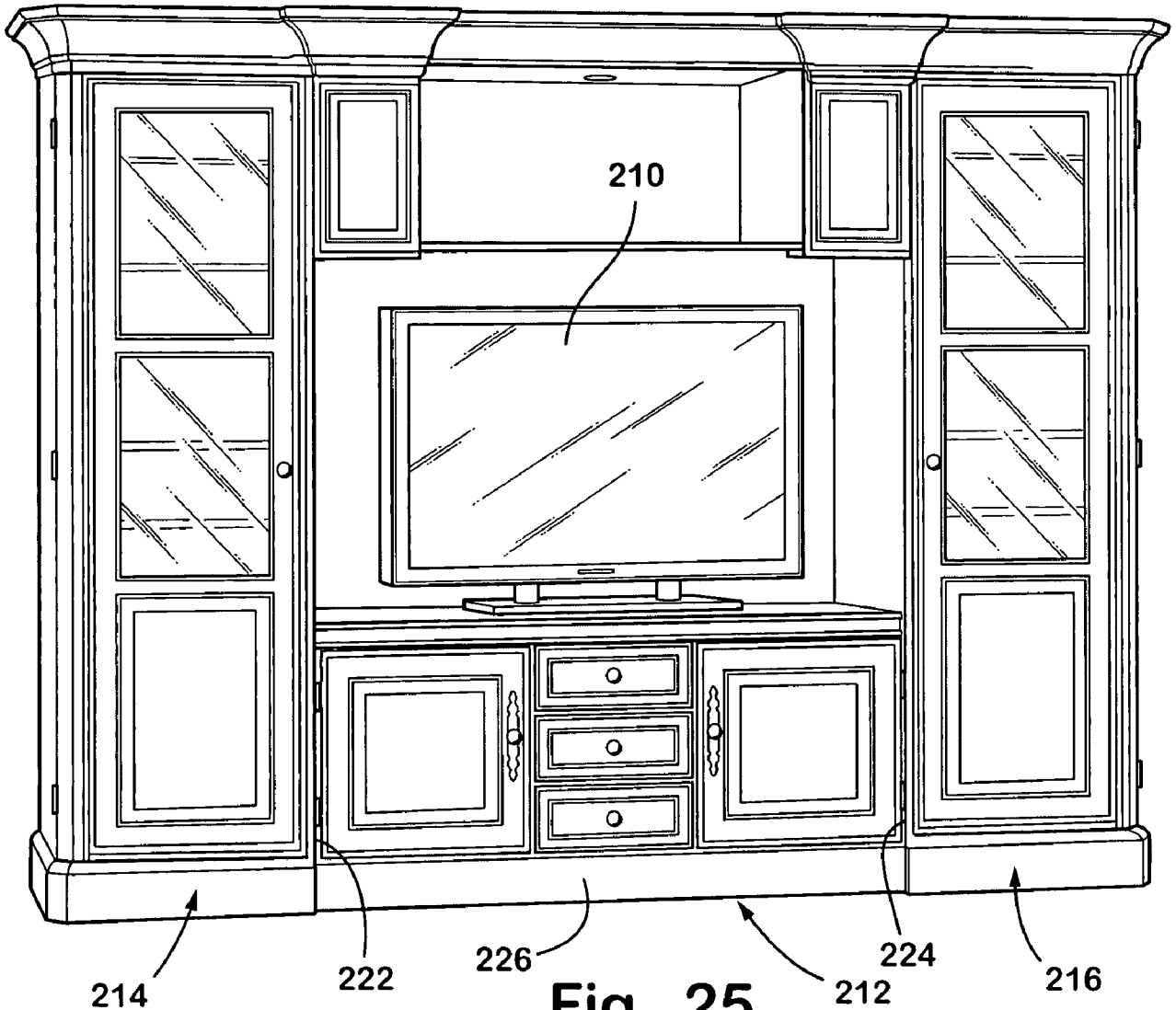
FIG. 25 is a perspective view of the home entertainment center of the present invention, shown with a table top television set or monitor mounted on a television stand/storage cabinet mounted in the television receptacle between the tower cabinets.
Figure 27:
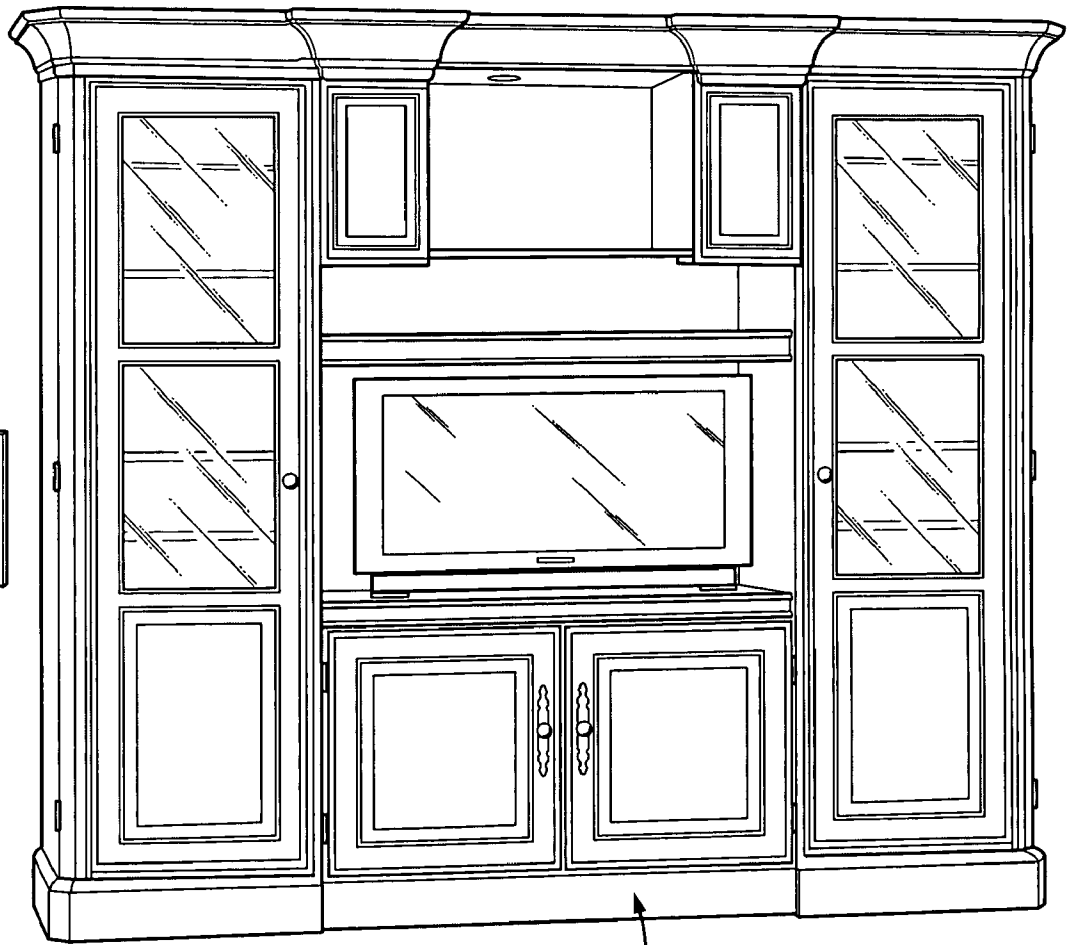
FIG. 27 is a perspective view as in FIG. 25 wherein a narrower television stand/storage cabinet is used instead of the one used in FIG. 25.
Figure 26:
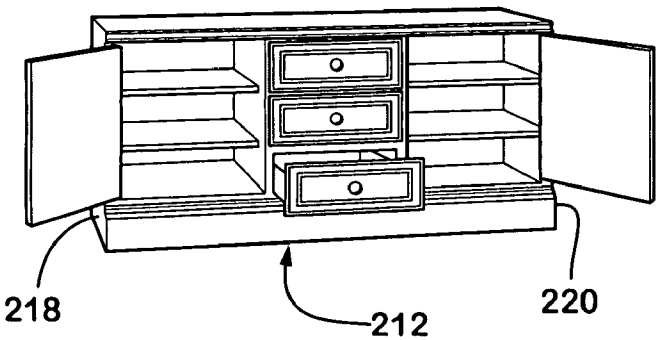
FIG. 26 is a perspective view of the television stand/storage cabinet of FIG. 25.

Desirably, more than one size of storage cabinet is available, so that the consumer can select a storage cabinet that most closely approximates the size of his television set. The television stand and storage cabinet 212 of FIGS. 25 and 26 is about sixty-two inches wide in the exemplary embodiment. A narrower television stand and storage cabinet 228, shown in FIG. 27, is about forty-five inches wide in the exemplary embodiment.

It should be understood that the foregoing is representative of a preferred embodiment of the present invention, and that various changes in the arrangements and details of construction of the embodiments disclosed herein may be made without departing from the spirit and scope of the present invention.

We claim:

1. An adjustable home entertainment cabinet assembly for enclosing television sets of different sizes, comprising:

a pair of spaced tower cabinets having tops, the tower cabinets having spaced, opposed inner sides and being movable between minimum and maximum spacing so as to position the inner sides adjacent the outer sides of television sets of different sizes;

a bridge assembly extending between the tops of the cabinets, the bridge assembly including:

a center section extending between the cabinets, the center section comprising an upper support member having opposite ends, each end resting on a respective cabinet top and being supported thereby, the length of the support member being such that the ends of the support member are supported on the tops of the cabinets when the cabinet are spaced apart by a desired spacing between minimum and maximum limits;

the center section further comprising a bookshelf mounted on an underside of the upper support member and extending downwardly therefrom between the cabinets, the bookshelf including laterally spaced end panels and at least one bottom panel extending between the end panels; and a pair of end sections movably mounted on the center section and extending downwardly from the upper support member so as to cover gaps between the bookshelf end panels and the inner sides of the tower cabinets, the end sections being mounted for relative lateral movement on the upper support member so that the end sections can be positioned next to the inner sides of the cabinets for a full range of spacing between the minimum and maximum spacing.

2. A home entertainment cabinet assembly as in claim 1 wherein:

the center section comprises cornice molding thereon that matches and is aligned with cornice molding on the tops of the tower cabinets; and the end sections each comprise a decorative front panel having cornice molding at an upper edge that matches and overlays the cornice molding on the front panel and tower cabinets.

3. A home entertainment cabinet assembly as in claim 2 wherein the end sections further include a generally horizontal bottom panel that extends rearwardly from a lower portion of the front panel and a generally vertical rear panel extending upwardly from an end of the bottom panel adjacent the tower cabinet, the end section bottom panel fitting under the center section bottom panel as the end section is moved inwardly over the center section bookshelf.

4. A home entertainment cabinet assembly as in claim 1 wherein the upper support member of the bridge assembly includes one or more elongated reinforcement ribs mounted on an upper support panel to restrict vertical deflection or sagging of the support panel.

5. A home entertainment cabinet assembly as in claim 1 wherein the upper support member includes recesses in one or more edges that engage protruding cleats on the tower cabinets to prevent the upper support member from sliding off the tower cabinets.

6. A home entertainment cabinet assembly as in claim 1 and further including means for limiting the distance the upper support member can slide toward and away from the tower cabinets, said means preventing the upper support member from sliding off the top of the tower cabinets.

7. A home entertainment cabinet assembly as in claim 1 wherein the cabinet includes lights mounted on the tops of the tower cabinets and upper support member and directing illumination downwardly therefrom, the upper support member including recessed portions that permit the upper support member to slide outwardly over the slights on the tops of the tower cabinets.

8. A home entertainment cabinet assembly as in claim 7 wherein the lights are actuated together by means of an electronic touch switch incorporated in a hinge of a door on a tower cabinet, such that the lights can be turned on and off by touching the hinge.

9. A home entertainment cabinet assembly as in claim 1 wherein:

the tower cabinets have cornice molding at a front top edge thereof the center section has cornice molding at a front edge thereof that matches and is aligned with the cornice molding on the tower cabinets; and the end sections have cornice molding on a top edge thereof that matches and overlays the cornice molding on the tower cabinets; and the end sections have cornice molding on a top edge thereof that matches and overlays the cornice molding on the tower cabinets and center section, the cornice molding on the end sections covering the gaps between the cornice molding on the tower cabinets and the center section for the range of movement of the tower cabinets between the minimum and maximum spacing.

10. A home entertainment cabinet assembly as in claim 9 and further comprising a gap reduction adjustment device that urges the cornice molding on the end sections into a close fitting relationship with the cornice molding on the tower cabinets, a back side of the cornice molding on the tower cabinets so they fit together closely with minimum gaps.

11. An adjustable home entertainment cabinet assembly for enclosing television sets of different sizes, comprising:

a pair of spaced tower cabinets having tops and having trim molding at the tops, the tower cabinets having spaced, opposed inner sides and being movable between minimum and maximum spacing so as to position the inner sides adjacent the outer sides of the television sets of different sizes;

a bridge assembly extending between the tops of the cabinets, the bridge assembly including:

a center section extending between the cabinets, the center section comprising an upper support member having ends, each end resting on a respective cabinet top and being supported thereby, the length of the support member being such that the ends of the support member are supported on the tops of the cabinets when the cabinets are spaced apart by a desired spacing between minimum and maximum limits;

the center section further comprising trim molding on a front edge thereof that matches and aligns with the trim molding on the tower cabinets; and a pair of end sections movably mounted on the center section and extending downwardly from the upper support member so as to cover a junction between the center section and the inner sides of the tower cabinets, the end sections being mounted for relative lateral movement on the upper support member so that the end sections can be positioned next to the inner sides of the cabinets for a full range of spacing between the minimum and maximum spacing, the end members including trim molding at an upper edge thereof that matches and overlays the trim molding on the tower cabinets and center section.

12. A home entertainment cabinet assembly as in claim 11, wherein the cabinet assembly includes at least one member from the group consisting of free standing television stands and storage cabinets of different widths for different sizes of table model television sets or monitors, with each television stand and storage cabinet having the same furniture appearance as the tower cabinets and having flat sides that mate with flat inner sides of the tower cabinets so as to create the impression of an integral item of furniture instead of separable furniture components.

* * * * *